US011112195B2

(12) United States Patent
Carre et al.

(10) Patent No.: US 11,112,195 B2
(45) Date of Patent: Sep. 7, 2021

(54) AMMUNITION BOX AND AMMUNITION MAGAZINE INTENDED TO RECEIVE SUCH A BOX

(71) Applicant: NEXTER SYSTEMS, Roanne (FR)

(72) Inventors: Maxime Carre, Bourges (FR); Steve Baert, Bourges (FR); Alexis Conte, Bourges (FR); Rémi Raymond, Bourges (FR)

(73) Assignee: NEXTER SYSTEMS, Roanne (FR)

( * ) Notice: Subject to any disclaimer, the term of this patent is extended or adjusted under 35 U.S.C. 154(b) by 0 days.

(21) Appl. No.: 16/954,037

(22) PCT Filed: Nov. 25, 2018

(86) PCT No.: PCT/EP2018/082462
§ 371 (c)(1),
(2) Date: Jun. 15, 2020

(87) PCT Pub. No.: WO2019/115210
PCT Pub. Date: Jun. 20, 2019

(65) Prior Publication Data

US 2020/0400395 A1 Dec. 24, 2020

(30) Foreign Application Priority Data

Dec. 13, 2017 (FR) ..... 17/01301

(51) Int. Cl.
*F41A 9/79* (2006.01)

(52) U.S. Cl.
CPC ..... *F41A 9/79* (2013.01)

(58) Field of Classification Search
CPC ..... F41A 9/61; F41A 9/79
USPC ..... 89/33.1, 33.14, 33.16, 33.17; 42/49.01, 42/50
See application file for complete search history.

(56) References Cited

U.S. PATENT DOCUMENTS 1,719,147 A * 7/1929 Tansley ..... F41A 9/34 89/33.14
1,790,867 A 2/1931 Jervey
1,800,595 A 4/1931 Browning
(Continued)

FOREIGN PATENT DOCUMENTS

FR 3 052 247 A1 12/2017
GB 1915 02756 A 1/1916

OTHER PUBLICATIONS

Feb. 11, 2019 International Search Report issued in International Patent Application No. PCT/EP2018/082462.
(Continued)

*Primary Examiner* — Bret Hayes
(74) *Attorney, Agent, or Firm* — Oliff PLC

(57) ABSTRACT

An ammunition box that is intended to equip a magazine of a gun turret. The box is substantially parallelepipedic and comprises a pivoting handle formed by two arms that are articulated on the side walls and are connected by a grip allowing the extraction and transportation of the box. The handle comprises a protuberance disposed in the vicinity of at least one of the articulated arms and in the vicinity of its pivot pin on the walls, which protuberance is intended to engage with at least one guide groove provided on the magazine of the turret. A further aim of the invention is a magazine capable of receiving such a box.

17 Claims, 5 Drawing Sheets

(56) References Cited

U.S. PATENT DOCUMENTS

| | | | | | |
|---|---|---|---|---|---|
| 2,401,762 | A | * | 6/1946 | Irasek | F41A 9/79 89/34 |
| 2,776,599 | A | | 1/1957 | Starry | |
| 3,788,189 | A | | 1/1974 | Sachleben, Sr. et al. | |
| 4,903,575 | A | * | 2/1990 | Capawana | F41A 9/79 42/50 |
| 4,976,369 | A | * | 12/1990 | Shindo | B65D 43/0258 220/270 |
| 6,484,880 | B1 | * | 11/2002 | Shaeffer | A45C 5/005 132/315 |
| 10,663,241 | B2 | | 5/2020 | Baert et al. | |
| 2019/0264996 | A1 | | 8/2019 | Baert et al. | |

OTHER PUBLICATIONS

Feb. 11, 2019 Written Opinion issued in International Patent Application No. PCT/EP2018/082462.

Aug. 15, 2018 French Search Report issued in French Patent Application No. 1701301.

Aug. 15, 2018 Written Opinion issued in French Patent Application No. 1701301.

* cited by examiner

AMMUNITION BOX AND AMMUNITION MAGAZINE INTENDED TO RECEIVE SUCH A BOX

The invention relates to the technical field of ammunition boxes as well as magazines intended to receive such boxes.

It is known to define gun turrets that are equipped with ammunition magazines containing several removable ammunition boxes.

Such an arrangement indeed makes it possible to facilitate the resupply of the weapon. The boxes have a reduced volume and a reduced mass. They are supplied with ammunition in strips made up of links. They are next arranged in the magazine of the weapon, and the strips are connected to one another, from one box to the next.

U.S. Pat. No. 3,788,189 describes one such type of turret equipped with two ammunition boxes fastened laterally in a magazine.

Patent application FR3052247 also describes a turret comprising two lateral magazines, each magazine being able to receive several ammunition boxes.

This last turret further has the particularity of being able to receive the boxes inserted vertically or horizontally.

In all cases, the problem arises of securing the box and the magazine.

It is in fact necessary to prevent the boxes from moving during firing or during movements of the vehicle bearing the turret.

To that end, patent application FR3052247 proposes to dispose spacers between two panels of the magazine, wherein these spacers delimit housings intended to receive the boxes. The boxes that can be inserted horizontally are also maintained owing to the rear door of the magazine.

Such a solution does not keep a box in a given location reliably enough. Furthermore, the spacers hinder the horizontal insertion of the boxes and, concretely, only two boxes can be inserted horizontally, all of the others having to be inserted vertically.

It is the aim of the invention to propose an ammunition box, as well as a magazine suitable for receiving such a box, and which do not have such drawbacks.

Thus, with the box and the magazine according to the invention, the boxes are fastened reliably in locations that are defined upon the design of the weapon system.

The placement and removal of the boxes do not require any particular tool, the simple maneuvering of the handle of the box sufficing to ensure the locking or unlocking of the box.

Thus, the invention relates to an ammunition box that is intended to equip a magazine of a gun turret, which box is substantially parallelepipedic and comprises two front walls that are parallel to one another and two side walls that are parallel to one another and perpendicular to the front walls, the box comprising a pivoting handle formed by two arms articulated on the side walls and connected by a grip allowing the extraction and transportation of the box, which box is characterized in that the handle comprises a protuberance provided at at least one of the articulated arms and in the vicinity of its pivot pin on the walls, which protuberance is intended to engage with at least one guide groove provided on the magazine of the turret.

According to one embodiment, the protuberance may form a prismatic overthickness machined in the arm.

According to another embodiment, the overthickness may be made in the form of a small plate fastened to one of the arms.

According to another embodiment, the protuberance may be made in the form of tongues cut and bent in the arm.

Preferably, the protuberance may comprise rounded ends.

The invention also relates to an ammunition magazine secured to a gun turret and intended to receive at least one ammunition box according to the invention, the magazine comprising at least two panels delimiting an inner volume able to receive the box or boxes, which magazine is characterized in that at least one of the panels comprises at least one groove that emerges on at least one substantially cylindrical housing, the groove being intended to ensure the guiding of the protuberance of the handle of a box, the cylindrical housing being intended to cooperate with the protuberance so as to ensure locking of the box once the latter is placed and the grip of the handle is tilted in low position.

According to one embodiment, the panel may include at least one vertical groove allowing the insertion of at least one box into the magazine in a vertical direction.

According to another embodiment, the panel may include at least one horizontal groove allowing the insertion of at least one box into the magazine in a horizontal direction.

According to one preferred embodiment, a magazine that is intended to receive at least two ammunition boxes disposed adjacent to one another will have a panel that comprises a horizontal groove and at least two vertical grooves, each vertical groove emerging on the horizontal groove in the vicinity of a separate cylindrical housing.

The invention will be better understood upon reading the following description of one particular embodiment, the description being done in reference to the appended drawings and in which.

Figure 5A:
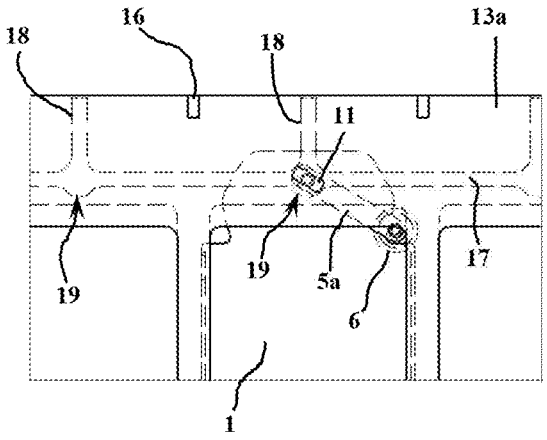
Figure 5B:
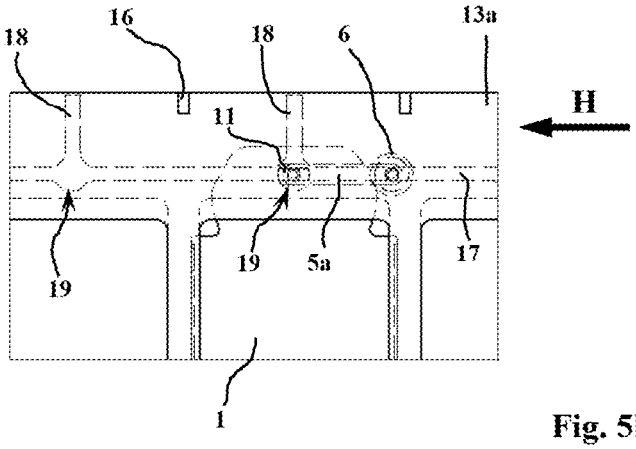
Figure 5C:
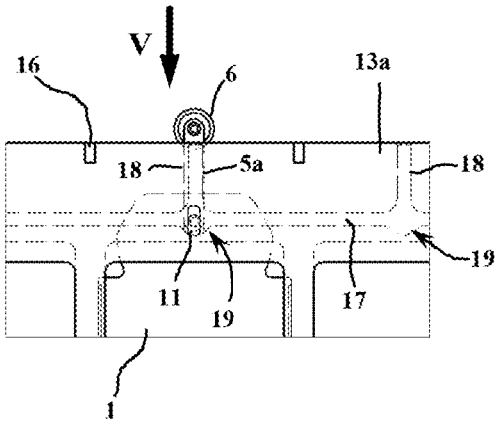
Figure 6A:
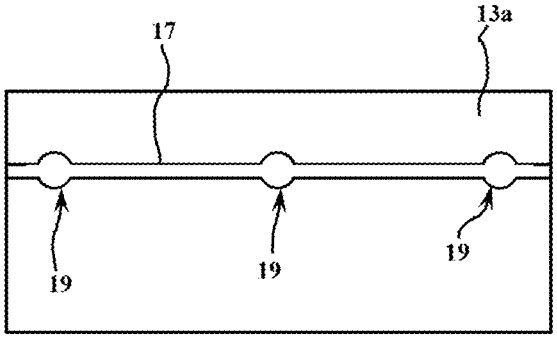
Figure 6B:
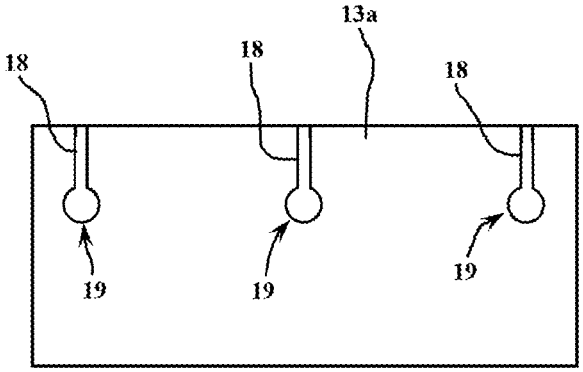
Figure 7A:
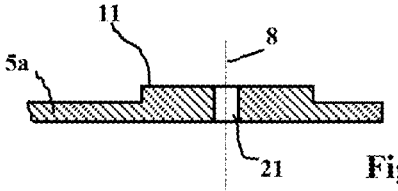
Figure 7B:
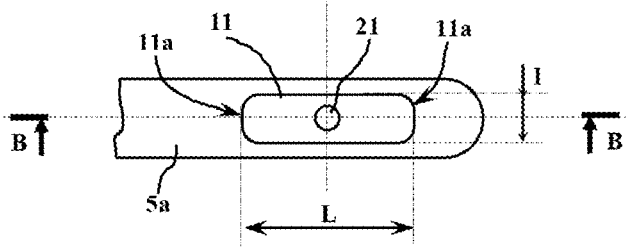

FIG. 5*a* shows a box placed in the magazine and in the locked position;

FIG. 5*b* shows a box placed in the magazine and in the unlocked position, before horizontal movement;

FIG. 5*c* shows a box placed in the magazine and in the unlocked position, before vertical movement;

FIGS. 6*a* and 6*b* show two variants of embodiment of a panel of a magazine according to the invention;

FIGS. 7*a* and 7*b* are two detail views showing the end of an arm bearing a protuberance according to one embodiment of the invention, FIG. 7*a* being a sectional view along the section plane identified BB in FIG. 7*b;*

Figure 8A:
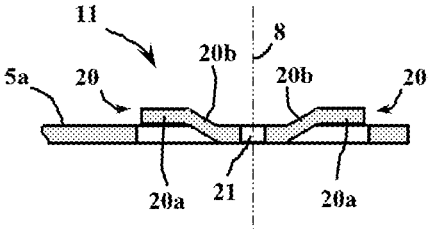
Figure 8B:
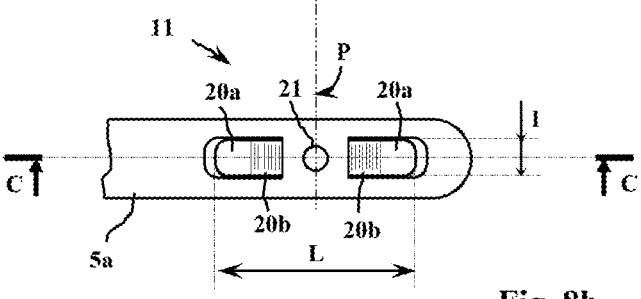

FIGS. 8*a* and 8*b* are two detail views showing the end of an arm bearing a protuberance according to another embodiment of the invention, FIG. 8*a* being a sectional view along the section plane identified CC in FIG. 8*b.*

Figure 1:
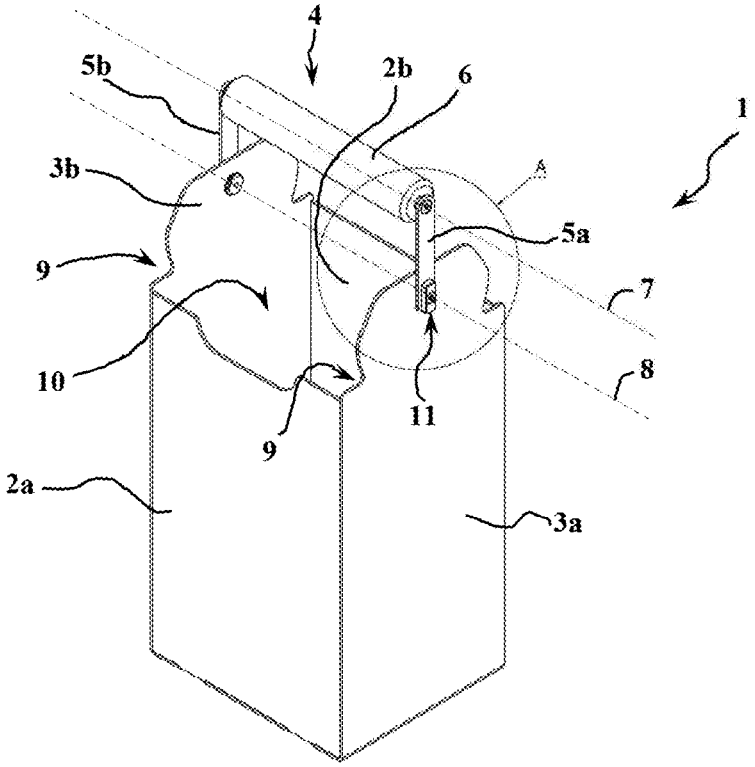
FIG. 1 is a perspective view of a box according to one embodiment of the invention.
Figure 2:
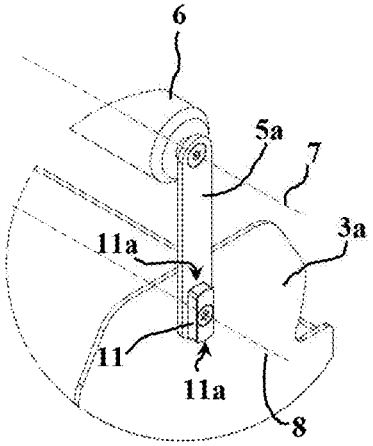
FIG. 2 is an enlarged view of the box and its handle, view of the zone surrounded by the circle identified A in FIG. 1.

In reference to FIGS. 1 and 2, an ammunition box 1 according to the invention is intended to equip a magazine of a gun turret (not shown).

This box 1 is substantially parallelepipedic and comprises two front walls 2*a* and 2*b* that are parallel to one another and two side walls 3*a* and 3*b* that are also parallel to one another and perpendicular to the front walls.

The box 1 comprises a pivoting handle 4 that is formed by two arms 5*a* and 5*b* articulated on the side walls 3*a* and 3*b* and connected by a grip 6 allowing the extraction and transportation of the box 1. Each arm 5*a* or 5*b* can pivot on one of the side walls 3*a* or 3*b* at a pivot pin 8. The pivot pin 8 comprises a mechanical fastening element, for example a rod comprising a threaded part receiving a nut (not shown). The figures show, in the form of a broken line, only the geometric outline of the pivot pin 8.

As described in patent application FR3052247, the grip 6 is mounted freely pivoting on a pivot pin 7. When the grip 6 is folded over toward a front part 2*a* or 2*b* of the box 1, the pivot pin 7 bears against the box 1 at notches 9 (see also FIG. 5*a*). The grip 6 is then positioned above the inner volume 10 of the box 1 and can pivot freely at this place. The grip 6 thus forms a roller making it possible to guide a strip of ammunition (not shown) between a box 1 and its neighbor, while reducing friction. It is possible to provide for an assembly of the grip 6 on a needle bearing to facilitate this pivoting.

As shown more particularly in FIG. 2 and FIGS. 7*a* and 7*b*, one of the arms 5 of the handle 4 comprises a protuberance 11 that is provided in the vicinity of its pivot pin 8 on the wall 3*a*.

The protuberance 11 here is made in the form of a prismatic overthickness obtained directly by machining of the arm. The protuberance could alternatively be a small plate 11 fastened to one of the arms 5*a* (glued or welded). The protuberance 11 (or the small plate) is substantially parallelepipedic and comprises rounded ends 11*a*.

In the remainder of the disclosure, the terms "protuberance" and "small plate" will be associated with one another, what is disclosed in fact applying indifferently to a protuberance monobloc with the arm or to a small plate attached on the arm.

FIGS. 7*a* and 7*b* more specifically show the protuberance 11 machined in the arm. The hole 21 allows the passage of a threaded rod secured to the pivot pin 8.

If the protuberance 11 is made in the form of an attached small plate, it can simply be pinched on the arm by a nut (not shown) during the assembly of the pivot pin 8.

Figure 3:
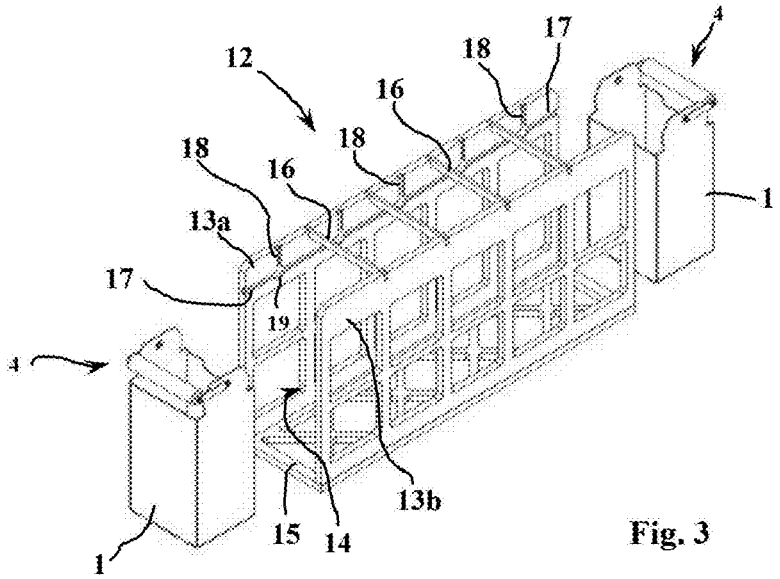
FIG. 3 is a partial perspective view of a magazine intended to receive boxes.

As shown in FIG. 3, the box 1 is intended to be placed in an ammunition magazine 12. This magazine 12 is secured to a gun turret (not shown). Reference may be made to patent application FR3052247, which provides a detailed description of such a turret.

The magazine 12 is intended to receive several ammunition boxes 1 (here, two boxes are shown). The magazine 12 includes at least two panels 13*a* and 13*b* that delimit an inner volume 14 able to receive the box or boxes 1.

Figure 4:
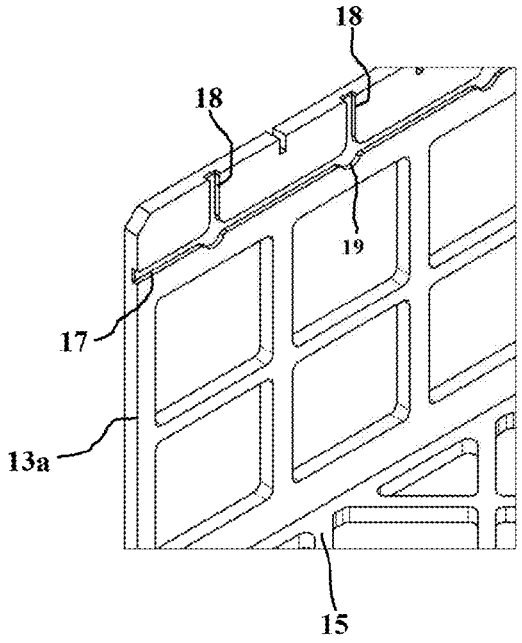
FIG. 4 is an enlarged view showing the panel of the magazine bearing the grooves.

As shown in FIGS. 3 and 4, the panels 13*a* and 13*b* are open-worked to reduce their mass. They are connected by a bottom plate 15 and spacer strips 16 also connect them at their upper ends. The panels 13*a*, 13*b*, the bottom plate 15 and the strips 16 are fastened to one another, for example by welding.

As shown more clearly in FIG. 4, the panel 13*a* includes a horizontal groove 17 that extends over the entire length of the panel 13*a*.

The panel 13*a* also bears five vertical grooves 18 spaced apart evenly, the distance separating two vertical grooves 18 is substantially equal to the width of the side walls 3*a*, 3*b* of the box.

Cylindrical housings 19 are disposed at the end of the vertical grooves 18 and they are passed through by the horizontal groove 17.

The grooves 17 and 18 and the housings 19 are made by milling of the panel 13*a*. The width of the vertical grooves 18 is equal to that of the horizontal groove 17 and also the width 1 of the protuberance (or small plate) 11 (cf. FIGS. 7*a* and 7*b*).

The diameter of the housing 19 is equal to the length L of the protuberance (or small plate) 11.

Thus, the grooves 17 or 18 can ensure the guiding of the protuberance (or small plate) 11 of the handle 4 of a box 1.

In reference to FIG. 5*c*, which shows the placement of a box 1 in a vertical direction V, one can see that, when the grip 6 of the handle 4 of the box is in the upper position, that is to say, with the arms 5*a* and 5*b* vertical, the protuberance (or the small plate) 11 is housed in the considered groove 18, which allows the lowering of the box into the magazine 12.

Furthermore, the groove 18 ensures that the arms 5*a* and 5*b* are maintained in their vertical position.

In light of FIG. 5*a*, when the protuberance (or the small plate) 11 is positioned in the cylindrical housing 19, the groove 18 no longer keeps the arms 5*a* and 5*b* vertical, and the latter can tilt and the grip 6 of the handle 4 is then in its low position.

It will be noted that in this position, the protuberance (or the small plate) 11 forms an angle of about 45° between the vertical and horizontal directions. The protuberance (or the small plate) 11 is maintained by the cylindrical housing 19, the diameter of which is substantially equal to the length L of the protuberance (or small plate) 11.

The box 1 is therefore blocked in its position and can no longer move vertically or horizontally.

The cylindrical housing 19 thus cooperates with the protuberance (or the small plate) 11 so as to ensure locking of the box 1 once the latter is in place, and the grip 6 of the handle 4 is tilted in the low position.

As shown in FIG. 5*b*, it is also possible to place a box 1 in a horizontal direction H. It suffices to position the box at one end of the magazine 12 while keeping the handle 4 with its arms 5*a* and 5*b* horizontal. In this case, the protuberance (or the small plate) 11 is positioned in the horizontal groove 17, which ensures that the arms 5*a* and 5*b* are kept in their horizontal position.

When, after pushing of the box 1, the protuberance (or the small plate) 11 is positioned in a cylindrical housing 19, the groove 17 no longer keeps the arms 5*a* and 5*b* horizontal, and the latter can tilt and the grip 6 of the handle 4 is then in its low position.

Owing to the invention, the box 1 is effectively locked in a location intended to receive it, whether the box is placed vertically or horizontally.

During a horizontal placement of several boxes, it suffices to raise the handle in order to pass a first cylindrical housing 19 and be able to fasten the box further away, in the vicinity of another cylindrical housing 19.

Here, the positioning of a protuberance (or small plate) 11 on only one of the arms 5*a* has been described. Furthermore, there are grooves 17 and 18 on only one of the two panels 13*a* or 13*b*.

This solution advantageously makes it possible to ensure mistake-proofing during the placement of the boxes. Indeed, due to the presence of the protuberance (or of the small plate), the box can only be inserted with the orientation allowing the insertion of the protuberance (or of the small plate) in the considered groove 17 or 18.

It is of course possible to provide such a protuberance (or small plate) 11 on each of the arms 5*a* and 5*b*. In this case, grooves 17 and 18 and cylindrical housings 19 will be made on both panels 13*a* and 13*b*. Such a variant makes it possible to balance the locking forces between the two panels.

An embodiment has also been disclosed here in which the magazine 12 bears at least one horizontal groove 17 and vertical grooves 18. This embodiment allows the placement of the boxes 1 in the magazine 12, in horizontal or vertical directions indifferently.

It is also possible, as shown in FIG. 6*a*, to make a magazine 12 that does not comprise vertical grooves. In this case, the boxes will only be able to be inserted horizontally. The horizontal groove(s) 17 will bear, at regular intervals, cylindrical housings 19 embodying the locking positions for the boxes.

Conversely, it is also possible, as shown in FIG. 6*b*, to make a magazine that does not comprise horizontal grooves. In this case, the boxes will only be able to be inserted vertically. Each vertical groove 18 will bear, at its end, a cylindrical housing 19 embodying the locking position for the box.

As a variant, it is possible to produce the protuberance 11 in a form other than a machined overthickness or an attached small plate.

It will for example be possible to make, on the arms 5*a*, 5*b*, cuts and bends located to embody the ends of the protuberance 11.

FIGS. 8*a* and 8*b* show such a variant in which the end of one arm 5*a* bears two tongues 20, cut in the very material of the arm 5*a*, and bent. Each tongue 20 thus includes a flat part 20*a* substantially parallel to the arm 5*a* and an inclined part 20*b* that connects the flat part 20*a* to the arm 5*a*.

The tongues 20 are disposed symmetrically relative to a plane P, perpendicular to the arm 5*a*, and passing through the hole 21 receiving the pivot pin 8.

The tongues 20 thus protrude relative to the arm 5*a* and form the protuberance 11. They have a width 1 substantially equal to that of the grooves 17 and 18 borne by the magazine 12.

The length L separating the ends of each tongue is also substantially equal to the diameter of the housing 19 in which the one or more grooves 17 and/or 18 emerges.

The tongues 20 are, like in the preceding embodiment, guided by the grooves 17 and 18 and they make it possible, through their cooperation with the housing 19, to lock an ammunition box in a magazine.

The invention claimed is:

1. An ammunition box that is configured to equip a magazine of a gun turret, the ammunition box being substantially parallelepipedic and comprising two end walls that are parallel to one another and two side walls that are parallel to one another and perpendicular to the end walls, the ammunition box comprising a pivoting handle formed by two arms that are articulated on the side walls and are connected by a grip allowing extraction and transportation of the ammunition box, wherein the handle comprises a protuberance provided at at least one of the arms and in a vicinity of a pivot pin of the handle on the walls, the protuberance being an overthickness of the handle in a direction parallel to the pivot pin, so that the protuberance is able to engage with at least one guide groove provided on a magazine of a turret.

2. The ammunition box according to claim 1, wherein the protuberance forms a prismatic overthickness machined in the arm.

3. The ammunition box according to claim 1, wherein the protuberance is made as a small plate fastened to one of the arms.

4. The ammunition box according to claim 1, wherein the protuberance is made as tongues cut and bent in the arm.

5. The ammunition box according to claim 1, wherein the protuberance comprises rounded ends.

6. An ammunition magazine secured to a gun turret and intended to receive at least one ammunition box according to claim 1, the magazine comprising at least two panels delimiting an inner volume able to receive the at least one ammunition box, wherein at least one of the panels comprises at least one groove that emerges on at least one substantially cylindrical housing, the groove being intended to ensure guiding of the protuberance of the handle of an ammunition box, the cylindrical housing being intended to cooperate with the protuberance so as to ensure locking of the ammunition box once the ammunition box is placed and the grip of the handle is tilted in a low position.

7. The ammunition magazine according to claim 6, wherein the panel includes at least one vertical groove allowing insertion of the at least one ammunition box into the ammunition magazine in a vertical direction.

8. The ammunition magazine according to claim 6, wherein the panel includes at least one horizontal groove allowing insertion of the at least one ammunition box into the ammunition magazine in a horizontal direction.

9. The ammunition magazine according to claim 6 and intended to receive at least two ammunition boxes disposed adjacent to one another, wherein the panel comprises a horizontal groove and at least two vertical grooves, each vertical groove emerging on the horizontal groove at a separate cylindrical housing.

10. An ammunition magazine secured to a gun turret and receiving at least one ammunition box, the at least one ammunition box configured to equip the ammunition magazine, the at least one ammunition box being substantially parallelepipedic and comprising two end walls that are parallel to one another and two side walls that are parallel to one another and perpendicular to the end walls, the ammunition box comprising a pivoting handle formed by two arms that are articulated on the side walls and are connected by a grip allowing extraction and transportation of the ammunition box, wherein the handle comprises a protuberance provided at at least one of the arms and in a vicinity of a pivot pin of the handle on the walls, the protuberance configured to engage with at least one guide groove provided on the ammunition magazine;

the ammunition magazine comprising at least two panels delimiting an inner volume able to receive the at least one ammunition box, wherein at least one of the panels comprises at least one groove that emerges on at least one substantially cylindrical housing, the groove being intended to ensure guiding of the protuberance of the handle of the at least one ammunition box, the cylindrical housing being intended to cooperate with the protuberance so as to ensure locking of the at least one ammunition box once the at least one ammunition box is placed and the grip of the handle is tilted in a low position.

11. The ammunition magazine according to claim 10, wherein the protuberance forms a prismatic overthickness machined in the arm.

12. The ammunition magazine according to claim 10, wherein the protuberance is made as a small plate fastened to one of the arms.

13. The ammunition magazine according to claim 10, wherein the protuberance is made as tongues cut and bent in the arm.

14. The ammunition magazine according to claim 10, wherein the protuberance comprises rounded ends.

15. The ammunition magazine according to claim 10, wherein the panel includes at least one vertical groove allowing insertion of the at least one ammunition box into the ammunition magazine in a vertical direction.

16. The ammunition magazine according to claim 10, wherein the panel includes at least one horizontal groove allowing insertion of the at least one ammunition box into the ammunition magazine in a horizontal direction.

17. The ammunition magazine according to claim 10 and intended to receive at least two ammunition boxes disposed adjacent to one another, wherein the panel comprises a horizontal groove and at least two vertical grooves, each vertical groove emerging on the horizontal groove at a separate cylindrical housing.

* * * * *